US006783229B1

(12) United States Patent
Inamoto et al.

(10) Patent No.: US 6,783,229 B1
(45) Date of Patent: Aug. 31, 2004

(54) RECORDING MEDIUM, IMAGE FORMING PROCESS USING THE SAME, AND PROCESS FOR THE PREPARATION OF THE SAME

(75) Inventors: Tadayoshi Inamoto, Hachioji (JP); Nobuyuki Hosoi, Kazo (JP); Kenji Shinjo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/157,497

(22) Filed: Sep. 21, 1998

(30) Foreign Application Priority Data

Sep. 24, 1997 (JP) ..... 9-258534

(51) Int. Cl.[7] ..... B41M 5/00

(52) U.S. Cl. ..... 347/105; 428/32.15; 428/32.25; 428/32.34

(58) Field of Search ..... 428/195, 328, 428/327, 329, 32.25, 32.15, 32.34; 347/105

(56) References Cited

U.S. PATENT DOCUMENTS 4,722,868 A * 2/1988 Pope ..... 428/480
5,185,213 A * 2/1993 Fujita et al. ..... 428/500
5,405,678 A * 4/1995 Bilodeau ..... 347/105
5,495,981 A * 3/1996 Warther ..... 229/71
5,525,400 A * 6/1996 Manser et al. ..... 428/195
5,576,088 A * 11/1996 Ogawa et al. ..... 428/327

FOREIGN PATENT DOCUMENTS

| | | |
|---|---|---|
| EP | 0 782 934 A1 | 7/1997 |
| JP | 54-59936 | 5/1979 |
| JP | 57-784 | 1/1982 |
| JP | 64-43826 | 2/1989 |
| JP | 2-31673 | 7/1990 |
| JP | 3-24906 | 4/1991 |
| JP | 4-37577 | 2/1992 |
| JP | 7-237348 | 9/1995 |
| JP | 8-2090 | 1/1996 |

OTHER PUBLICATIONS

Japanese Patent 57–784, Jan. 1982, Yasujima et al., full translation.*

* cited by examiner

*Primary Examiner*—Pamela R. Schwartz
(74) *Attorney, Agent, or Firm*—Fitzpatrick, Cella, Harper & Scinto

(57) ABSTRACT

Provided is a recording medium provided with an ink-receiving layer on at least one surface of a substrate, wherein said ink-receiving layer is composed of a porous layer comprising pigment particles and mutually fused thermoplastic resin particles.

6 Claims, 1 Drawing Sheet

RECORDING MEDIUM, IMAGE FORMING PROCESS USING THE SAME, AND PROCESS FOR THE PREPARATION OF THE SAME

BACKGROUND OF THE INVENTION

1. Field of the Invention

The present invention relates to a recording medium for image formation by an ink-jet recording system, and more particularly to a recording medium suitable for use in a credit card, a bank card, a prepaid card, or the like, an image forming process using the recording medium, and a process for the preparation of the recording medium.

2. Related Background Art

Conventional cards, such as credit cards, bank cards, prepaid cards, etc. contain various information therein. Such information is recorded for example by digitizing the information and recording such information by magnetic recording, or in the form of a bar code, or by so-called optical recording with a laser beam to ablate a part of the optical recording layer or to generate a change in the reflectance thereof or a deformation therein, on a record bearing member, wherein the recording and reproduction of information are achieved by the difference in the optical reflectance or transmittance. There are also utilized an embossing method in which characters and numerals are represented by a protruding part of a card deformed unevenly, and ordinary printing methods such as screen printing or offset printing.

However, the recorded data cannot be read with the human eye in the case of magnetic recording, bar code recording or optical recording of the digitized information. It is therefore not easy to confirm whether the information recorded on the card actually belongs to the holder of the card.

Also, the printing of character information indicating the cautions or regulations for the use of the card and that of logo, background pattern or picture are executed in advance by ordinary printing methods such as screen printing or offset printing. In such printing, however, there are required printing plates corresponding to the number of colors to be printed, and such printing plates cannot be prepared within a short time and become expensive when a small number of cards is to be printed. For this reason, such printing is limited to general information common to a large number of cards, and individual information is currently recorded separately in the form of digital data explained above.

The embossing method, which expresses characters or numerals by means of protruding portions of a card deformed unevenly, allows visual confirmation, but is associated with drawbacks that the amount of information is limited and that such characters or numerals cannot be easily colored. Besides, there is also a drawback that, as such embossing is obtained by deforming the card, the recording area for magnetic or optical recording cannot be provided on such an embossed area.

Recording of individual information, such as a photograph of a face of the card owner, is already adopted in some cards.

However, for example in a method of adhering a photograph itself onto the card, card preparation within a short time is difficult. There is also a problem in a method of printing the photograph directly on the card that the information recording medium may be affected by a surface treatment or printing. Also, a sublimation transfer printing method is associated with a drawback of a high running cost because the ink ribbon is expensive. Further, there has to be selected a base material of satisfactory printability.

For resolving these drawbacks, there has been disclosed a card in which an ink-receiving layer is laminated on a card substrate and on which information is recorded by an ink-jet recording system.

Japanese Patent Application Laid-Open No. 57-784 discloses a card provided, on a card medium, with an ink-receiving layer and further with an ink permeable slidable layer thereon.

However, such medium is defective in safety and in ecology, since the coating liquid contains organic solvent. Also, such a medium is difficult to apply to practical use, because, in a case of using such structure with a polyvinyl chloride substrate ordinarily employed in credit cards, bank cards, etc., the substrate itself is eroded by the solvent to result in a curvature of the card or a cracking of the coated layer.

Japanese Patent Application Laid-Open No. 64-43826 discloses a card in which an ink-receiving layer is laminated on a card substrate and information is recorded by an ink-Jet recording system, but water-fastness and durability of the ink-receiving layer seem to be insufficient.

Japanese Patent Publication No. 3-24906 discloses an ink-receiving layer containing cationic hydrated aluminum oxide, and Japanese Patent Application Laid-Open No. 4-37577 discloses an ink-receiving layer containing alumina hydrate.

Japanese Patent Publication No. 2-31673 discloses an ink Jet recording medium in which an inorganic pigment layer of high ink absorbability is provided on a substrate and further an outermost fine particle layer of thermoplastic organic polymer is laminated subsequently. Also, Japanese Patent Application Laid-Open No. 7-237348 discloses an ink-jet recording sheet in which a porous layer of alumina hydrate is provided on a substrate and an outermost porous polymer layer is laminated thereon. Furthermore, Japanese Patent Application Laid-Open No. 8-2090 discloses a similar card-shaped ink-jet recording medium.

In these media, the outermost porous resin layer is made non-porous by thermal treatment after ink-jet recording has been conducted. Stated differently, the image formation or absorption and fixation of ink are effected in the inorganic pigment layer composed for example of porous alumina hydrate, and water fastness and durability are achieved by the porous resin layer which has been rendered non-porous.

However, the inorganic pigment layer composed for example of porous alumina hydrate is insufficient in flexibility, and, when such layer is applied to the substrate for example of polyvinyl chloride mentioned above, there will result a drawback that the ink-receiving layer is peeled off by the deformation in embossing. Also, in case of an ink-jet recording system employing a pigment as the coloring material of the ink, the pigment particles constituting the coloring material do not intrude into the ink-receiving layer, which results in insufficient friction resistance of the obtained image. Furthermore, as polyvinyl chloride has a softening temperature as low as 60° C. to 80° C., there has not been disclosed any effective method for preventing the deformation of the substrate due to the heat treatment for preparing the recording medium or for rendering the outermost porous resin layer non-porous.

SUMMARY OF THE INVENTION

An object of the present invention is to provide an excellent recording medium causing no deformation.

Another object of the present invention is to provide an image forming process for forming an image by a simple method on the above-mentioned recording medium.

Further, still another object of the present invention is to provide a process for the preparation of a recording medium causing no deformation.

The above objects can be achieved by the present invention described below.

According to the present invention there is provided a recording medium provided with an ink-receiving layer on at least one surface of a substrate, wherein the ink-receiving layer is a porous layer comprising pigment particles and mutually fused thermoplastic resin particles.

According to the present invention there is also provided an image forming process comprising the step of forming an image by ejecting an ink by an ink-jet recording method onto the above-mentioned recording medium.

According to the present invention there is still further provided a process for the preparation of a recording medium comprising the steps of applying to a substrate a coating liquid comprising pigment particles and thermoplastic resin particles and forming an ink-receiving layer by fuse-gathering the thermoplastic resin with heat under pressure.

According to the present invention there is further provided a process for the preparation of a recording medium comprising the steps of applying to a substrate a coating liquid comprising pigment particles and thermoplastic resin particles; and forming an ink-receiving layer by fusing and adhering the thermoplastic resin with heat under pressure.

DESCRIPTION OF THE PREFERRED EMBODIMENTS

Figure 1:
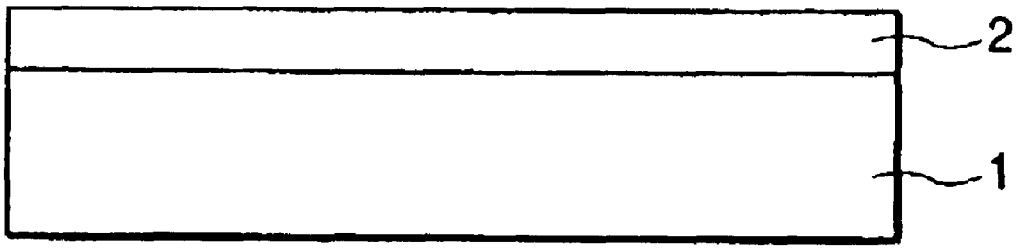
FIG. 1 is a schematic cross-sectional view showing an example of the recording medium of the present invention.
Figure 2:
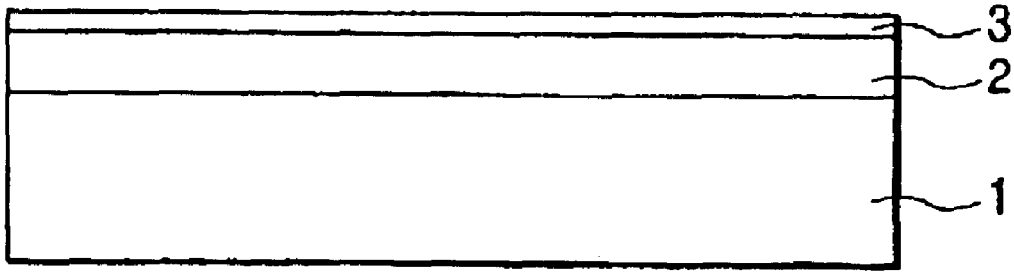
FIG. 2 is a schematic cross-sectional view showing another example of the recording medium of the present invention.

Now, the present invention will be described in detail with reference to FIGS. 1 and 2.

As the substrate 1 of the present invention, it is preferable to use a water-fast substrate. Otherwise a durable recorded image cannot be obtained due to moisture intrusion from the side of the substrate 1, even when a highly water-fast ink-receiving layer 2 is provided on a recording surface. The preferred examples of the substrate 1 include polyester resins such as polyethylene terephthalate, polybutylene terephthalate, a terephthalic acid-ethylene glycol-cyclohexane dimethanol copolymer of the formula

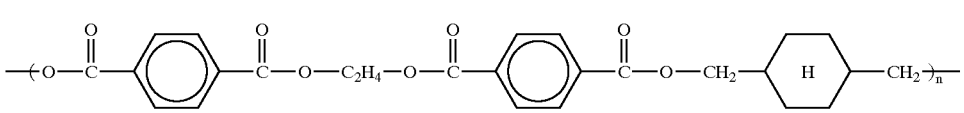

(I)

and the like, polyvinyl chloride resin, polyvinylidene chloride resin, epoxy resin, polycarbonate resin, polyethylene resin, polypropylene resin, polystyrene resin, vinyl chloride copolymers, vinyl acetate copolymers, polycarbonate, acrylonitrile-butadiene-styrene resin, a polymer alloy prepared by mixing the copolymer of formula (I) with a polycarbonate, and the like, and metals for certain applications. In consideration of close adhesion with the thermoplastic resin particles in the ink-receiving layer, preferred are polyvinyl chloride resin, polyvinylidene chloride resin, polycarbonate resin and polystyrene resin.

On a surface of the substrate 1 or on both surfaces thereof, there may be in advance formed a magnetic stripe for digital information recording, photomagnetic recording layer, IC and the like, or there may be in advance printed predetermined information such as a logo, cautions for use or regulations, for example by screen printing or offset printing. Namely, in the present invention there may be provided portions where various information is recorded, in addition to the ink-receiving layer 2. A thickness of the substrate 1 of the present invention is preferably within a range of from 0.2 to 1.0 mm, so that deformation is unlikely to occur.

An ink-receiving layer 2 may be provided on both surfaces of the substrate 1 and ink-jet recording may be conducted on both surfaces, or the ink-receiving layer 2 may be provided on either surface of the substrate 1. However, in case of an optical card, the ink-receiving layer is provided on a surface opposite to the surface used for recording and reproduction of optical information.

The recording medium of the present invention is preferably in the form of a rectangle or a circle, the length of a side or a diameter of which is from 30 to 130 mm, respectively, from the viewpoint of difficulty of deformation and ease of handling.

The substrate 1, to which an ink-receiving layer 2 is applied, may be prepared in advance in the final form, or may be formed into the final form, after the ink-receiving layer has been provided.

As the pigment particles in the ink-receiving layer 2, for example, silica gel, alumina hydrate, titanium oxide, calcium silicate, synthetic zeolite, zinc oxide, plastic pigment and the like may be used. The average particle size of the pigment particles is preferably in a range of from 0.01 to 5 $\mu$m.

As the thermoplastic resin particles in the ink-receiving layer, for example, particles of polyvinyl chloride, polyvinyl acetate, polyacrylate ester, polystyrene, polyethylene and the like may be used. There can also be employed particles of copolymers of corresponding monomers. The average particle size of such thermoplastic resin particles is preferably in a range of from 0.1 to 3 $\mu$m, more preferably from 0.2 to 2 $\mu$m. In the ink-receiving layer 2 there is contained mutually fused thermoplastic resin particles.

The thermoplastic resin particles are used for fixing the pigment by fusion and for realizing adhesion with the substrate 1. For this reason, there is used preferably a material capable of being fused and adhering closed to the substrate by heating. In case a pigment is employed as the coloring material of the ink, there is achieved improvement in the friction resistance, namely absence of detachment of the coloring material by friction. The mechanism for improvement of the friction resistance is not yet clarified, but is presumably because of a fact that the thermoplastic resin particles are deformed by fusion to form large gaps, thereby facilitating intrusion of the pigment particles. However, an excessively large amount of the thermoplastic resin particles reduces the amount of gaps, whereby the ink absorbability is deteriorated and a recording medium with satisfactory print quality cannot be obtained.

For attaining the above-mentioned objects, the ratio of the pigment particles to the thermoplastic resin particles in the ink-receiving layer 2 is desirably selected in such a manner that the thermoplastic resin is used in a range of from 1 to 40 parts by weight, preferably from 3 to 20 parts by weight, per 100 parts by weight of the pigment.

If necessary, the ink-receiving layer 2 may further contain a water-soluble polymer as a binder resin. For example there may be employed polyvinyl alcohol or modified products thereof, starch or modified products thereof, gelatin or modified products thereof, casein or modified products thereof, gum arabic, a cellulose derivative such as carboxymethyl cellulose, hydroxyethyl cellulose and hydroxypropyl cellulose, or polyvinyl pyrrolidone. The ratio of the pigment particles to the binder is such that the binder is preferably used at 40 parts by weight or less, more preferably 15 parts by weight or less, per 100 parts by weight of the pigment. The binder, if used in excess of the above-mentioned range, will block the gaps between the pigment particles, thereby deteriorating the ink absorbability.

If necessary, there may further be suitably added a pigment dispersant, a thickener, a defoamer, a foam suppressor, a fluorescent whitening agent, an ultraviolet absorber, an antioxidant, an antimold agent, etc.

In applying these materials to the substrate, the polymer component is dispersed or dissolved in a suitable solvent, and the pigment component is dispersed as finely as possible to obtain a coating liquid. Otherwise, the powder materials are mixed well and molded together with the substrate in a mold.

Most preferably, these materials are used as a dispersion in a solvent principally composed of water.

In a case that these materials are in the form of a dispersion, the ink-receiving layer may be applied onto the substrate by various coating methods such as screen printing, blade coating, air-knife coating, roll coating, curtain coating, bar coating, spray coating and the like.

The coating weight, calculated as solid after drying, is within a range of from 3 to 80 g/m$^2$, preferably from 5 to 40 g/m$^2$. A coating weight less than 3 g/m$^2$ cannot provide sufficient ink absorbability, so that a satisfactory image cannot be obtained. A coating weight larger than 80 g/m$^2$ cannot be obtained with a single coating operation and plural coating operations are required, which is disadvantageous in cost.

The wet coated substrate is subsequently dried in a dry air oven or with a heated drum. In a case that the substrate is composed of a material having a low softening temperature such as polyvinyl chloride resin, a drying temperature of from 60° C. to 70° C. is the highest limit for not causing deformation of the substrate.

Finally, according to the present invention, a heat treatment is thereafter executed in order to fuse the thermoplastic resin particles. The temperature of heat treatment is preferably within a range of from about 70 to about 180° C., though it cannot be said in general, because it varies depending on the substrate and the kind of thermoplastic resin particles. The temperature of such heat treatment is higher than the fusing and adhering temperature of the thermoplastic resin particles. The above-mentioned fusing and adhering temperature corresponds to the film forming temperature in case of emulsion or the molding temperature in case of molding resin. In a case that the substrate is a material having a low softening temperature such as polyvinyl chloride resin mentioned above, the substrate may be deformed with a fusing and adhering temperature higher than 60° C. Therefore, according to the present invention, such substrate is heated under constraint by pressure, which is one of the feature of the present invention. The pressurization is preferably made with a flat material such as a ferrotype plate and an iron plate with chrome plating, since otherwise the surface pattern of the pressing material is transferred onto the substrate or the ink-receiving layer. However, if a particular surface shape such as a matted surface is desired, the pressurization may be made with a material of corresponding surface shape. As to a pressing material, there may be used a plastic plate, a ceramic plate or a glass plate in addition to a metal plate such as a ferrotype plate. The pressure to be applied is determined depending on the materials constituting the substrate and the ink-receiving layer, but it is preferably within a range of from 0.01 to 20 kg/cm$^2$, more preferably within a range of from 0.01 to 15 kg/cm$^2$, in particular within a range of from 0.01 to 5kg/cm$^2$.

An excessively low pressure cannot provide sufficient adhesion close to the substrate, while an excessively high pressure crushes the substrate or blocks the gaps in the ink-receiving layer. The heating time is preferably from 5 to 10 minutes. After treatment, the substrate is cooled to room temperature under pressure.

In a more preferred embodiment of the recording medium of the present invention, an outermost layer 3 composed of a porous layer containing thermoplastic resin particles is provided on the ink-receiving layer 2.

The thermoplastic resin particles employed in the outermost layer 3 may be composed, for example, of particles of polyvinyl chloride, polyvinyl acetate, polyacrylate ester, polystyrene, polyethylene, etc. mentioned in the foregoing. There may also be employed particles of copolymers of monomers corresponding to these.

The average particle size of the thermoplastic resin particles employed in the present invention is preferably within a range of from 0.1 to 3 $\mu$m, more preferably from 0.2 to 2 $\mu$m and most preferably from 0.2 to 0.8 $\mu$m.

An average particle size of the thermoplastic resin particles of not more than 0.1 $\mu$m reduces the absolute pore volume of the outermost layer, thereby deteriorating the ink absorbability and the image quality. On the contrary, if the average particle size exceeds 5 $\mu$m, the surface smoothing becomes difficult or the surface luster is lowered in a case of rendering the surface non-porous after the printing operation.

Such porous layer containing the thermoplastic resin particles is formed by applying a coating liquid, with a solid content of the thermoplastic resin particles within a range of from 10 to 50% by weight, as the outermost layer on the ink-receiving layer provided in advance.

The thermoplastic resin particles have to be applied with such a thickness as to suppress the generation of interference light and to sufficiently function as a protective layer, and the outermost layer is preferably so applied as to obtain a dry thickness of from 2 to 10 $\mu$m.

As the ink for effecting ink-Jet recording on the above-described recording medium, any known ink can be used without any problem. Also, the coloring material can be a water-soluble dye such as direct dyes, acid dyes, basic dyes, reactive dyes or food dyes, or a dispersible dye or a pigment, and these materials can be used without any limitation. If emphasis is given to the weather fastness of the coloring material, there is advantageously employed a pigment dispersion. These coloring materials are generally used in a range of from 0.1 to 20% by weight in the conventional ink, and also in the present invention the same range may be used.

The solvent used in the aqueous ink employed in the present invention is water, or a mixture of water and a water-soluble organic solvent, preferably a mixture of water and a water-soluble organic solvent containing polyvalent alcohol having an effect for preventing ink drying.

The ink-jet recording method for forming a record by applying such ink onto the above-described recording medium can be any method capable of effectively dispatching the ink from the nozzle, thereby depositing the ink onto the recording medium. In particular, there can be effectively employed the ink-jet method disclosed in Japanese Patent Application Laid-Open No. 54-59936 in which the ink generates a rapid volume change due to thermal energy and is discharged from the nozzle by a force generated by such state change.

As the image immediately after the printing contains water and/or water-soluble organic solvent employed as solvent in the ink, and then such water and/or solvent is preferably removed. Such removal can be achieved by heating, pressure reduction, blowing of drying gas or a combination thereof.

In a case that there is the outermost layer 3, the recording medium of the present invention is heated after forming an image, so that the porous outermost layer 3 is made non-porous.

A method for making the outermost layer non-porous is preferably a heating treatment, and such treatment improves the weather fastness such as water fastness and light fastness, provides luster to the image and enables prolonged storage of the print. According to the present invention, as the underlying ink-receiving layer also contains thermoplastic resin, the fusion and adhesion with such resin achieves securer adhesion close to the outermost layer, thereby improving the durability of the recording medium, so that it can be applied to severe conditions of use such as an information recording medium.

The temperature of the heating treatment is preferably within a range of from 70° C. to 180° C., though variable in relation to the heating time, in consideration of the influence on the materials such as the substrate, ink-receiving layer and ink, and of the surface character after the treatment.

As explained in the foregoing, the substrate starts to deform when the heating temperature exceeds 60° C. to 80° C., in a case that the substrate is composed of a material of a low softening temperature such as polyvinyl chloride resin. In the present invention, therefore, in case of employing such substrate, the recording medium is not heated entirely, but the surface portion alone is irradiated in a non-contact manner with heating radiation such as infrared light, whereby the outermost layer and the adjacent surface portion of the ink-receiving layer alone are heated. Contact of the heat source with the recording medium is not preferred because the surface pattern of the heat source is transferred onto the surface of the thermoplastic resin, thereby deteriorating the luster of the recording medium, and also because the heat transmission to the substrate cannot be controlled.

In the following the present invention will be clarified further by examples thereof, but the present invention is by no means limited by such examples.

The recording on the recording medium was executed by a Canon bubble jet color printer BJC-620JW with the mode for a high-quality exclusive paper.

EXAMPLE 1

At first, particles of aluminum isopropoxide were subjected to hydrolysis/deflocculation to obtain alumina hydrate (sol) having a fiber bundle structure as the pigment. Then were added vinyl chloride particles (G-351, trade name, manufactured by Nippon Zeon Co., Ltd.; vinyl chloride latex with a film forming temperature of from 100 to 110° C.) as the thermoplastic resin particles. The ratio of the pigment particles to the thermoplastic resin particles was 100:15 by weight. The coating liquid thus obtained was applied to a white hard polyvinyl chloride resin plate, having a dimension of 500×500 mm and a thickness of 0.74 mm and having magnetic stripes, on a surface thereof opposite to the magnetic stripes, and the wet coated plate was dried for 20 minutes at 60° C. The thickness after drying was 40 $\mu$m. The resin plate was then sandwiched between flat ferrotype plates heated to 150° C., under a pressure of 0.1 kg/cm$^2$ for 5 minutes and gradually cooled to 40° C. over 1.5 hour.

Then, the vinyl chloride latex mentioned above was applied thereto by means of a wire bar, so as to provide a dry thickness of 3 $\mu$m, and was dried for 15 minutes at 50° C. The resin plate was then punched into a size of 80.6×54.0 mm, with rounded corners with a radius of 3.0 mm.

Ink-jet recording was conducted using the recording medium thus prepared by means of the above-mentioned ink-jet printer and with pigment inks described in the following:

Ink Compositions:

| | |
|---|---|
| Black ink: | |
| Carbon black pigment | 6 parts by weight |
| Styrene-acrylic acid copolymer (neutralized with monoethanolamine) | 2 parts by weight |
| Ethylene glycol | 25 parts by weight |
| Diethylene glycol | 7 parts by weight |
| Water | 60 parts by weight |
| Yellow ink: | |
| Benzidine yellow G pigment | 4 parts by weight |
| Styrene-acrylic acid copolymer (neutralized with monoethanolamine) | 1.5 parts by weight |
| Ethylene glycol | 25 parts by weight |
| Diethylene glycol | 7 parts by weight |
| Water | 62.5 parts by weight |
| Magenta ink: | |
| Quinachridone pigment | 4 parts by weight |
| Styrene-acrylic acid copolymer (neutralized with monoethanolamine) | 1.5 parts by weight |
| Ethylene glycol | 25 parts by weight |
| Diethylene glycol | 7 parts by weight |
| Water | 62.5 parts by weight |
| Cyan ink: | |
| Copper phthalocyanine blue pigment | 4 parts by weight |
| Styrene-acrylic acid copolymer (neutralized with monoethanolamine) | 1.5 parts by weight |
| Ethylene glycol | 25 parts by weight |
| Diethylene glycol | 7 parts by weight |
| Water | 62.5 parts by weight |

The printed polyvinyl chloride sheet was dried by heating for 30 minutes at 60° C. to eliminate volatile solvents in the ink.

Then the recording medium was subjected to a heating treatment under conditions that a gap of 0.2 mm was set between the recording medium and a heater having a heating area of 10 mm in width and 200 mm in length and having a surface temperature of 210° C., and a feed rate was set at 0.2 mm/sec, thereby obtaining an image print. The outermost latex layer could be rendered non-porous with minimal deformation of the recording medium.

The obtained image was clear and the coloring material was stable against rubbing. When the obtained image print was subjected to embossing, no peeling of the ink-receiving layer could be observed. Also after immersion in tap water for 100 hours, there could not be observed peeling of the ink-receiving layer, distortion in the image or loss of the image density. Furthermore, no change in the appearance could be observed after standing in an atmosphere of 40° C. and 90% RH for 50 hours.

EXAMPLE 2

Image formation was conducted in the same manner as in Example 1, except that the inks were replaced by the following ones. Evaluations in the same manner as in Example 1 provided results similar to those of Example 1.

| | |
|---|---|
| Dye | 5 parts by weight |
| Ethylene glycol | 15 parts by weight |
| Polyethylene glycol | 10 parts by weight |
| Water | 70 parts by weight |

Dyes used were:

C.I. Direct yellow 86 for a yellow ink,

C.I. Acid red 35 for a magenta ink,

C.I. Direct blue 199 for a cyan ink, and

C.I. Food black 2 for a black ink.

EXAMPLE 3

A card-shaped recording medium was prepared in the same manner as in Example 1, except that the pigment particles employed in the ink-receiving layer were replaced by colloidal silica (Snowtex ST-N, trade name, manufactured by Nissan Chemical Industries, Co.).

Image formation was conducted on such recording medium with the pigment inks employed in Example 1, and image prints were obtained through a process similar to that in Example 1. The outermost latex layer could be rendered non-porous with minimal deformation of the recording medium.

The obtained image was clear and the coloring material was stable against rubbing. When the obtained image print was subjected to embossing, no peeling of the ink-receiving layer could be observed. Also, after immersion in tap water for 100 hours, there could not be observed peeling of the ink-receiving layer, distortion in the image or loss of the image density.

EXAMPLE 4

A coating liquid was obtained by adding, to 100 parts by weight (solid) of alumina hydrate employed in Example 1, 10 parts by weight of polyvinyl alcohol (PVA117, trade name, manufactured by Kuraray Co.), 0.5 parts by weight of boric acid ($H_3BO_3$) and 10 parts by weight of vinyl chloride particles (same as in Example 1). This coating liquid was applied to a plate with magnetic stripes having a dimension of 500 mm width×500 mm length×0.74 mm thickness made of terephthalic acid-ethylene glycol-cyclohexane dimethanol copolymer (PETG, trade name, available from Eastman Chemical Co.), on a surface thereof opposite to the magnetic stripes, and the coated plate was dried at 60° C. for 20 minutes. The dry thickness was 40 $\mu$m. The dried plate was treated for 5 minutes by inserting it between plane ferrotype plates heated to 130° C. under pressure of 0.1 Kg/cm$^2$, and then gradually cooled to 40° C. over 1.5 hour.

The vinyl chloride latex mentioned above was applied thereto so as to provide a dry thickness of 3 $\mu$m by means of a wire bar, and dried at 50° C. for 15 minutes. Thereafter, the plate was punched out into a size of 80.6 mm×54.0 mm, with rounded corners with a radius of 3.0 mm.

Image formation was conducted on such recording medium with the pigment inks employed in Example 1, and image prints were obtained through a process similar to that in Example 1. The outermost latex layer could be rendered non-porous with minimal deformation of the recording medium.

The obtained image was clear and the coloring material was stable against rubbing. When the obtained image print was subjected to embossing, no peeling of the ink-receiving layer could be observed. Also after immersion in tap water for 100 hours, there could not be observed peeling of the ink-receiving layer, distortion in the image or loss of the image density.

EXAMPLE 5

A coating liquid was obtained by adding, to 100 parts by weight (solid) of alumina hydrate employed in Example 1, 10 parts by weight of polyvinyl alcohol (PVA117, trade name, manufactured by Kuraray Co.), 0.5 parts by weight of boric acid ($H_3BO_3$) and 10 parts by weight of vinyl chloride particles (same as in Example 1). Thereafter a process the same as in Example 1 was conducted, but the outermost layer was not formed, thereby obtaining a card-shaped recording medium with a single ink-receiving layer.

Image formation was conducted on such recording medium with the pigment inks employed in Example 1.

The obtained image was clear and the coloring material was stable against rubbing. When the obtained image print was subjected to embossing, no peeling of the ink-receiving layer could be observed. Also, after immersion in tap water for 100 hours, there could not be observed peeling of the ink-receiving layer, distortion in the image or loss of the image density. The color hue showed a slight change probably because of absorption of certain water, but the change was in the practically tolerable range. The change disappeared after drying.

Comparative Example 1

A card-shaped recording medium was obtained in the same manner as in Example 1, except that the thermoplastic resin particles were replaced by polyvinyl alcohol particles.

Image formation was conducted on such recording medium with the pigment inks employed in Example 1. Also, image prints were obtained by rendering the outermost layer non-porous through a process similar to that in Example 1. The recording medium scarcely showed deformation, but the area printed with the pigment ink did not show luster because the outermost latex layer could not be rendered sufficiently non-porous. The image print, when subjected to embossing, showed partial peeling of the ink-receiving layer.

Comparative Example 2

The procedure of Example 5 was repeated, except that the vinyl chloride particles were not added, and the outermost layer was not provided, thereby obtaining a card-shaped recording medium with a single ink-receiving layer.

Image formation was conducted on such recording medium with the pigment inks employed in Example 1.

The obtained image was clear, but the coloring material was partially lost by rubbing, which indicates that the coloring material was not introduced into the ink-receiving layer. When the obtained image print was subjected to embossing, partial peeling of the ink-receiving layer could be observed.

As explained in the foregoing, the present invention allows to inexpensively obtain a card-shaped recording medium on which the information of the individual person can be easily and clearly printed by an ink-jet recording system. Also, the image obtained on the card is stable even after prolonged standing under environmental conditions of high temperature and high humidity. Furthermore, the surface of the image shows a practically acceptable mechanical strength. Moreover, it is possible to use the recording medium concurrently with conventional magnetic or optical digital recording, screen or offset printing, or embossing.

What is claimed is:

1. A recording medium for ink-jet recording with an ink containing a pigment, provided with an ink-receiving layer on at least one surface of a substrate, wherein said ink-receiving layer comprises a porous layer comprising thermoplastic resin particles that have been mutually fused with no particle structure left and pigment particles, wherein the ink-receiving layer and the substrate are fused, and the ink receiving layer has gaps formed by the fusion of the thermoplastic resin particles, wherein the amount of the thermoplastic resin in the ink-receiving layer is 40% or less by weight of that of the pigment in the ink-receiving layer, and wherein said substrate has a thickness in the range of 0.2 to 1.0 mm, and is composed of at least one selected from the group consisting of a polyvinyl chloride resin, polystyrene resin, polycarbonate resin and polyvinylidene chloride resin.

2. The recording medium according to claim 1, wherein a porous outermost layer comprising thermoplastic resin particles is provided on the ink-receiving layer.

3. The recording medium according to claim 2, wherein said substrate is card-shaped.

4. An image forming process comprising the steps of:

forming an image by discharging ink by an ink-jet recording method onto the recording medium according to claim 2, and rendering said outermost layer transparent.

5. The recording medium according to claim 1, wherein said pigment particles are composed of alumina hydrate.

6. An image forming process comprising the step of forming an image by ejecting an ink by an ink-jet recording method onto the recording medium according to claim 1.

* * * * *

UNITED STATES PATENT AND TRADEMARK OFFICE

CERTIFICATE OF CORRECTION

PATENT NO. : 6,783,229 B1
DATED : August 31, 2004
INVENTOR(S) : Tadayoshi Inamoto et al.

It is certified that error appears in the above-identified patent and that said Letters Patent is hereby corrected as shown below:

Title page,
Item [*] Notice, insert -- This patent issued on a continued prosecution application filed under 37 CFR 1.53(d), and is subject to the twenty year patent term provisions of 35 U.S.C. 154(a)(2). --

Signed and Sealed this

Twenty-first Day of December, 2004

JON W. DUDAS
*Director of the United States Patent and Trademark Office*